US009830875B2

(12) United States Patent
Cho et al.

(10) Patent No.: US 9,830,875 B2
(45) Date of Patent: Nov. 28, 2017

(54) GATE DRIVER AND DISPLAY APPARATUS HAVING THE SAME

(71) Applicant: Samsung Display Co., Ltd., Yongin, Gyeonggi-Do (KR)

(72) Inventors: Se Hyoung Cho, Hwaseong-si (KR); Dongwoo Kim, Seongnam-si (KR); Kyung-Hoon Kim, Uiwang-si (KR); Ilgon Kim, Seoul (KR); Meehye Jung, Suwon-si (KR)

(73) Assignee: Samsung Display Co., Ltd. (KR)

( * ) Notice: Subject to any disclaimer, the term of this patent is extended or adjusted under 35 U.S.C. 154(b) by 145 days.

(21) Appl. No.: 14/719,086

(22) Filed: May 21, 2015

(65) Prior Publication Data

US 2016/0180817 A1 Jun. 23, 2016

(30) Foreign Application Priority Data

Dec. 18, 2014 (KR) ..... 10-2014-0183232

(51) Int. Cl.
*G09G 3/36* (2006.01)
*G09G 3/20* (2006.01)

(52) U.S. Cl.
CPC ..... *G09G 3/3677* (2013.01); *G09G 3/20* (2013.01); *G09G 2310/0267* (2013.01); *G09G 2320/0223* (2013.01)

(58) Field of Classification Search
CPC ..... G09G 3/3677; G09G 3/20; G09G 2310/0267; G09G 2320/0223
See application file for complete search history.

(56) References Cited

U.S. PATENT DOCUMENTS

| | | | | |
|---|---|---|---|---|
| 7,133,034 | B2 | 11/2006 | Park | |
| 8,508,460 | B2 | 8/2013 | Takahashi | |
| 2009/0066679 | A1* | 3/2009 | Kanazawa | G09G 3/288 345/206 |
| 2013/0321252 | A1 | 12/2013 | Hu et al. | |
| 2014/0078124 | A1 | 3/2014 | Chen | |
| 2014/0118327 | A1* | 5/2014 | So | G11C 19/28 345/212 |

FOREIGN PATENT DOCUMENTS

| | | |
|---|---|---|
| KR | 10-2011-0076450 | 7/2011 |
| KR | 10-1112213 | 2/2012 |
| KR | 10-2014-0015777 | 2/2014 |

* cited by examiner

*Primary Examiner* — Sahlu Okebato
(74) *Attorney, Agent, or Firm* — Innovation Counsel LLP

(57) ABSTRACT

Provided is a display device. The display apparatus includes a plurality of data lines, a data driver, a plurality of gate lines, gate drivers, wherein the gate drivers includes first gate drivers connected to one end of a first group of the plurality of gate lines and second drivers connected to the other end of a second group of the plurality of gate lines, compensation circuits for compensating a rising time and falling time of gate signals outputted from the gate drivers, wherein the compensation circuits includes first compensation circuits connected to the other end of the first group of the plurality of gate lines and second compensation circuits connected to one end of the second group of the plurality of gate lines; and a plurality of pixels are respectively disposed on areas between the gate drivers.

12 Claims, 10 Drawing Sheets

GATE DRIVER AND DISPLAY APPARATUS HAVING THE SAME

CROSS-REFERENCE TO RELATED APPLICATIONS

This U.S. non-provisional patent application claims priority under 35 U.S.C. §119 to Korean Patent Application No. 10-2014-0183232, filed on Dec. 18, 2014, the entire contents of which are hereby incorporated by reference.

BACKGROUND

The present disclosure herein relates to a display apparatus.

Recently, various flat panel display devices which are capable of reducing the weight and volume that are disadvantages of a cathode ray tube have attracted attention. Examples of such a flat panel display device include liquid crystal displays, field emission displays, plasma display panels, and organic electroluminescence display devices.

Flat panel display devices are used in image display devices such as televisions, computer monitors, and the like to display various images and characters as well as moving pictures. Particularly, an active matrix-type liquid crystal display device in which liquid crystal cells are driven by using a thin film transistor has superior image quality and low power consumption. Thus, the active matrix-type liquid crystal display device is being rapidly developed into a large size and high resolution due to the development of the recent manufacturing technology and the output of the recent research and development.

Even though the flat panel display device has the large size and high resolution as described above, efforts for minimizing deterioration of the display quality are required. Also, studies for realizing a narrow bezel in addition the large size and the high resolution of the flat panel display device are being actively progressed.

SUMMARY

The present disclosure provides a display device that is capable of realizing a slim bezel and minimizing deterioration of display quality. Embodiments of the present invention provide display apparatuses including: a plurality of data lines; a data driver connected to an end of each of the plurality of data lines; a plurality of gate lines; gate drivers connected to the plurality of gate lines, wherein the gate drivers include first gate drivers connected to one end of a first group of the plurality of gate lines and second drivers connected to the other end of a second group of the plurality of gate lines; compensation circuits for compensating a rising time and falling time of gate signals outputted from the gate drivers, wherein the compensation circuits include first compensation circuits connected to the other end of the first group of the plurality of gate lines and second compensation circuits connected to one end of the second group of the plurality of gate lines; and a plurality of pixels are respectively disposed on areas between the gate drivers.

In some embodiments, the first and second gate drivers may be disposed to face each other with an intervening display area on which the plurality of pixels are disposed.

In other embodiments, the first and second compensation circuits may be disposed to face each other with the intervening display area.

In still other embodiments, the first gate drivers and the second compensation circuits may be alternately arranged in a vertical direction, and the second gate drivers and the first compensation circuits may be alternately arranged in the vertical direction.

In even other embodiments, the gate drivers may be connected to first nodes of the compensation circuits through gate lines connected thereto, respectively.

In yet other embodiments, each of the compensation circuits may include: a precharge circuit compensating the rising time of each of the gate signals; and a discharge unit compensating the falling time of each of the gate signals.

In further embodiments, the discharge unit may include a first transistor that is connected between each of the first nodes and a first voltage terminal and controlled by an inversion clock signal.

In still further embodiments, the inversion clock signal may include a signal in which a clock signal inputted into the gate driver connected to the compensation circuit including the discharge unit is inverted.

In even further embodiments, the first voltage terminal may have a ground voltage level.

In yet further embodiments, the precharge circuit may include: a second transistor connected between the first node and the clock signal; and a third transistor connected between a gate of the second transistor and the clock signal, the third transistor including a gate connected to the first node.

In much further embodiments, the precharge circuit may further include a first capacitor connected between the first node and the gate of the second transistor.

In still much further embodiments, the precharge circuit may further include a second capacitor connected between the gate of the second transistor and a gate of the first transistor.

In even much further embodiments, the display apparatuses may further include: a fourth transistor connected between the gate of the second transistor and a second voltage terminal; and a third capacitor connected between a gate of the further transistor and the gate of the second transistor.

In yet much further embodiments, the second voltage terminal may have a voltage level less than that of the first voltage terminal.

In much still further embodiments, the precharge circuit may include: a second transistor connected between the first node and a non-inversion clock signal; a third transistor connected between the gate of the second transistor and the clock signal, the fifth transistor being controlled by a gate signal received from a previous gate driver; a fourth transistor connected between a gate of the second transistor and a second voltage terminal, the fourth transistor being controlled by the inversion clock signal; and a third capacitor connected between the gate of the second transistor and a gate of the fourth transistor.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION OF THE EMBODIMENTS

The objects, other objectives, features, and advantages of the inventive concept will be understood through preferred embodiments below and the accompanying drawings. The inventive concept may, however, be embodied in different forms and should not be construed as limited to the embodiments set forth herein. Rather, these embodiments are provided so that this disclosure will be thorough and complete, and will fully convey the scope of the present invention to those skilled in the art.

Figure 1:
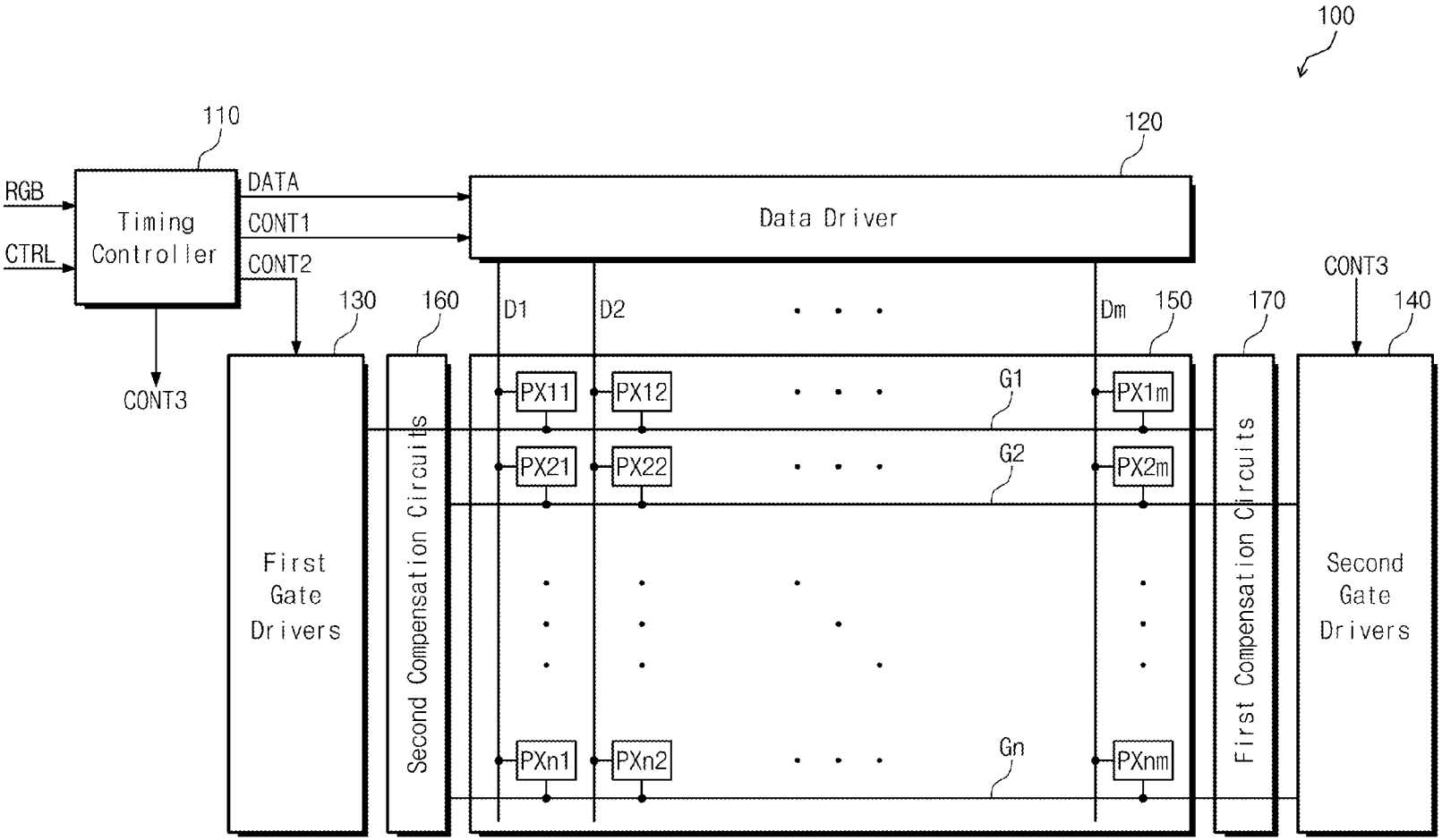
FIG. 1 is a block diagram of a display device.

FIG. 1 is a block diagram of a display device.

Referring to FIG. 1, a display device 100 includes a display panel 150, a timing controller 110, a data driver 120, gate drivers 130 and 140, and first and second compensation circuits 170 and 160.

The display area 150 may include a plurality of data lines D1 to Dm and a plurality of gate lines G1 to Gn. The plurality of data lines D1 to Dm may be intersected with the plurality of gate lines G1 to Gn and be disposed on the display panel 150. The plurality of data lines D1 to Dm are insulated from the plurality of gate lines G1 and Gn. The display area 150 may include a plurality of pixels PX11 to PXnm that are arranged in a matrix form on intersection areas between the plurality of data lines D1 to Dm and the plurality of gate lines G1 to Gn.

The display area 150 may receive data signals and gate signals from the data driver 120 connected to the plurality of data lines D1 to Dm and the gate drivers 130 and 140 connected to the plurality of gate lines G1 to drive the plurality of pixels PX11 to PXnm, thereby displaying an image.

Particularly, the gate lines G1 to Gn may be grouped into first and second groups through various manners. For example, odd-numbered lines G1, G3, . . . , and Gn-1 of the gate lines G1 to Gn may be grouped into the first group, and even-numbered lines G2, G4, . . . , and Gn of the gate lines G1 to Gn may be grouped into the second group. Furthermore, in various embodiments, the gate lines G1 to Gn may be grouped into first and second groups, but is not limited to the above-described embodiment. The grouped gate lines G1 to Gn may be connected to the corresponding gate drivers 130 and 140 to transmit the gate signals to the pixels PX11 to PXnm.

The display device 100 may include a liquid crystal display panel, an organic light emitting display panel, an electrophoretic display panel, and an electrowetting display panel. However, the present disclosure is not limited to the above-described embodiment.

The timing controller 110 receives an image signal RGB and control signals CTRL for controlling display of the image signal RGB from the outside. For example, the timing controller 110 may receive a vertical synchronizing signal, a horizontal synchronizing signal, a main clock signal, and a data enable signal as the control signals CTRL. The timing controller 110 may generate image data DATA and driving signals CONT1, CONT2, and CONT3 which match operation conditions of the display area 150 on the basis of the image signal RGB and the control signals CTRL. The timing controller 110 provides the image data DATA and the data driving signals CONT1 to the data driver 120 and provides the gate driving signals CONT2 and CONT3 to the gate drivers 130 and 140. The data driving signals CONT1 include a horizontal synchronizing signal, a clock signal, and a line latch signal. The gate driving signals CONT2 and CONT3 include a vertical synchronizing starting signal, an output enable signal, a gate pulse signal, and a dummy enable signal.

The data driver 120 transmits the data signals through the data lines D1 to Dm connected thereto in response to the image data DATA and data driving signals CONT1 that are received from the timing controller 110.

The gate drivers 130 and 140 transmits the gate signals to the gate lines G1 to Gn connected thereto in response to the gate driving signals CONT2 and CONT3 that are received from the timing controller 110.

The gate drivers 130 and 140 may be divided into first gate drivers 130 and second gate drivers 140 according to the gate lines G1 to Gn connected thereto. In more detail, the gate drivers 130 connected to the first group gate lines G1, G3, . . . , and Gn-1 of the gate lines G1 to Gn may be defined as the first gas drivers 130, and the gate drivers 140 connected to the second group gas lines G2, G4, . . . , and Gn of the gate lines G1 to Gn may be defined as the second gate driver 140.

For example, when the odd-numbered gate lines G1, G3, . . . , and Gn-1 is grouped into the first group, and the even-numbered gate lines G2, G4, . . . , and Gn is grouped into the second group, the gate drivers 130 connected to the odd-numbered gate lines G1, G3, . . . Gn-1 may be defined as the first gate drivers 130, and the gate drivers 140 connected to the even-numbered gate lines G2, G4, . . . , and Gn may be defined as the second gate drivers 140.

The first and second gate drivers 130 and 140 may be disposed to face each other with an intervening display area 150 on which the pixels PX11 to PXnm are disposed. Also, the first and second gate drivers 130 and 140 may receive the first and second gate driving signals CONT2 and CONT3 from the timing controller 110.

The first and second gate drivers 130 and 140 may successively transmit the gate signals to the gate lines G1 to Gn connected thereto. For example, when the first gate driver 130 transmits a first gate signal to the first gate line G1, the second gate driver 140 may transmit a second gate signal to the second gate line G2 that is vertically adjacent to the first gate line G1. This method may be called an interlace manner.

However, when the interlace manner is applied, a gate signal propagation delay may be a problem. The gate signal disposed close to the gate driver 130 and 140 and the gate signal disposed away from the gate driver 130 and 140 may be different due to RC delay. As the gate signal propagation delay occurs, charging times of the pixels PX11 to PXnm may also be different from each other. As a result, horizontal line defects in which gradation of an image is differently shown at each of the gate lines G1 to Gn may be seen by the user.

Thus, to prevent the horizontal line defects from occurring, each of the gate drivers 130 and 140 may be connected to each of the compensation circuits 160 and 170 for compensating a rising time and falling time of the gate signals. A specific structure of each of the compensation circuits 160 and 170 will be described later in detail with reference to FIGS. 3 to 7.

The compensation circuits 160 and 170 may be divided into first compensation circuits 170 and second compensation circuits 160 according to the gate drivers 130 and 140 connected thereto. The first compensation circuits 170 may be compensation circuits connected to the first gate drivers 130 through the first group gate lines G1, G3, . . . , and Gn-1, and the second compensation circuits 160 may be compensation circuits connected to the second gate drivers 140 through the second group gate lines G2, G4, . . . , and Gn. Thus, the first group gate lines G1, G3, . . . , and Gn-1 may have one ends connected to the first gate drivers 130 and the other ends connected to the first compensation circuits 170. Also, the second group gate lines G2, G4, . . . , and Gn may have one ends connected to the second compensation circuits 160 and the other ends connected to the second gate drivers 140.

The first and second compensation circuits 160 and 170 may be disposed in a one-to-one correspondence with the first and second gate drivers 130 and 140. However, the present disclosure is not limited thereto. For example, the gate drivers 130 and 140 and the compensation circuits 160 and 170 may be disposed in an N:M correspondence with each other according to a design method of a manufacturer.

The divided first and second compensation circuits 160 and 170 may be disposed to face each other with the intervening display area 150 on which the pixels PX11 to PXnm are disposed. An arrangement method of the first and second gate drivers 130 and 140 and the first and second compensation circuits 160 and 170 will be descried below in detail.

Figure 2A:
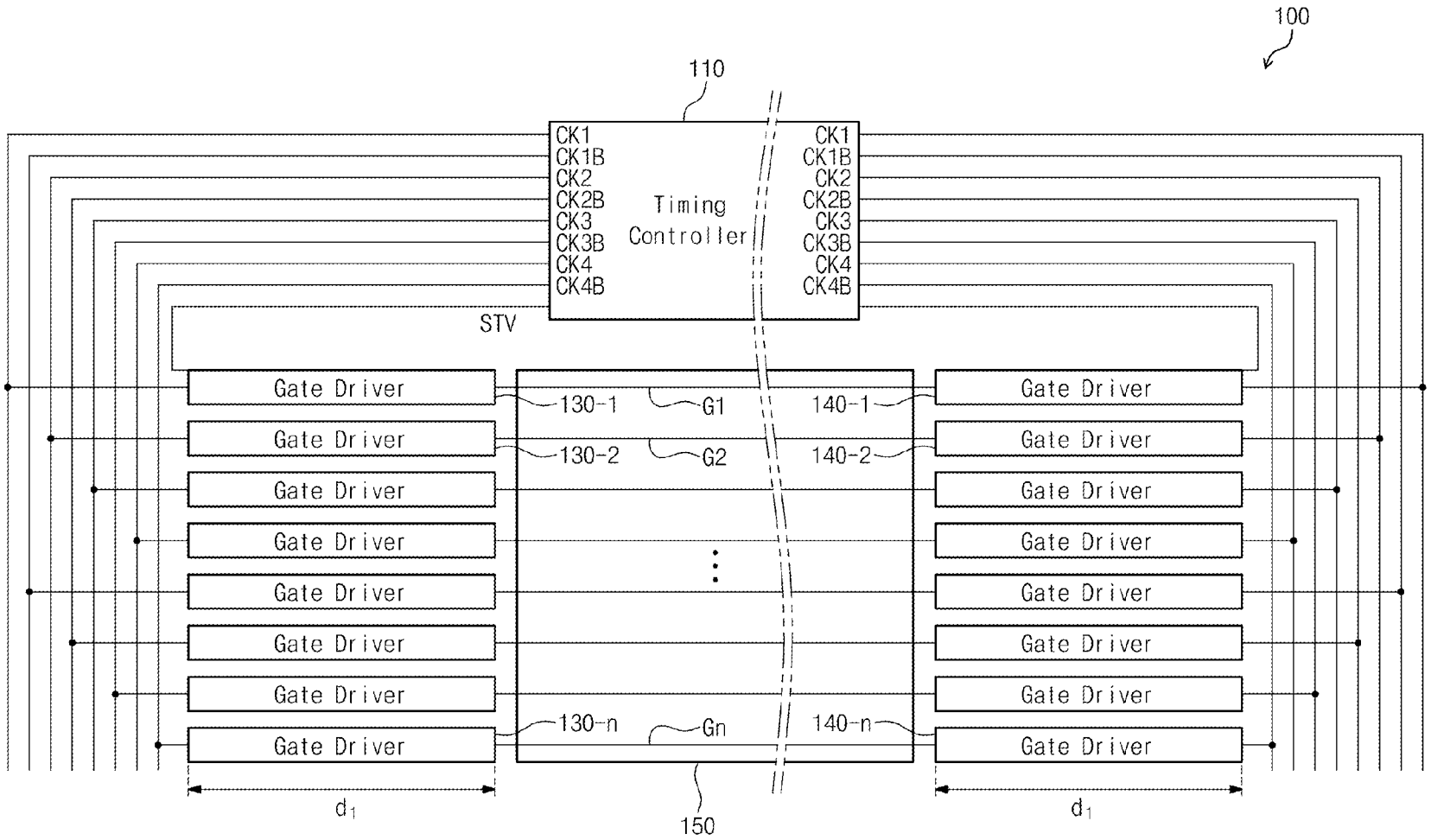
FIG. 2A is a block diagram of a display device that is driven in a dual manner.
Figure 2B:
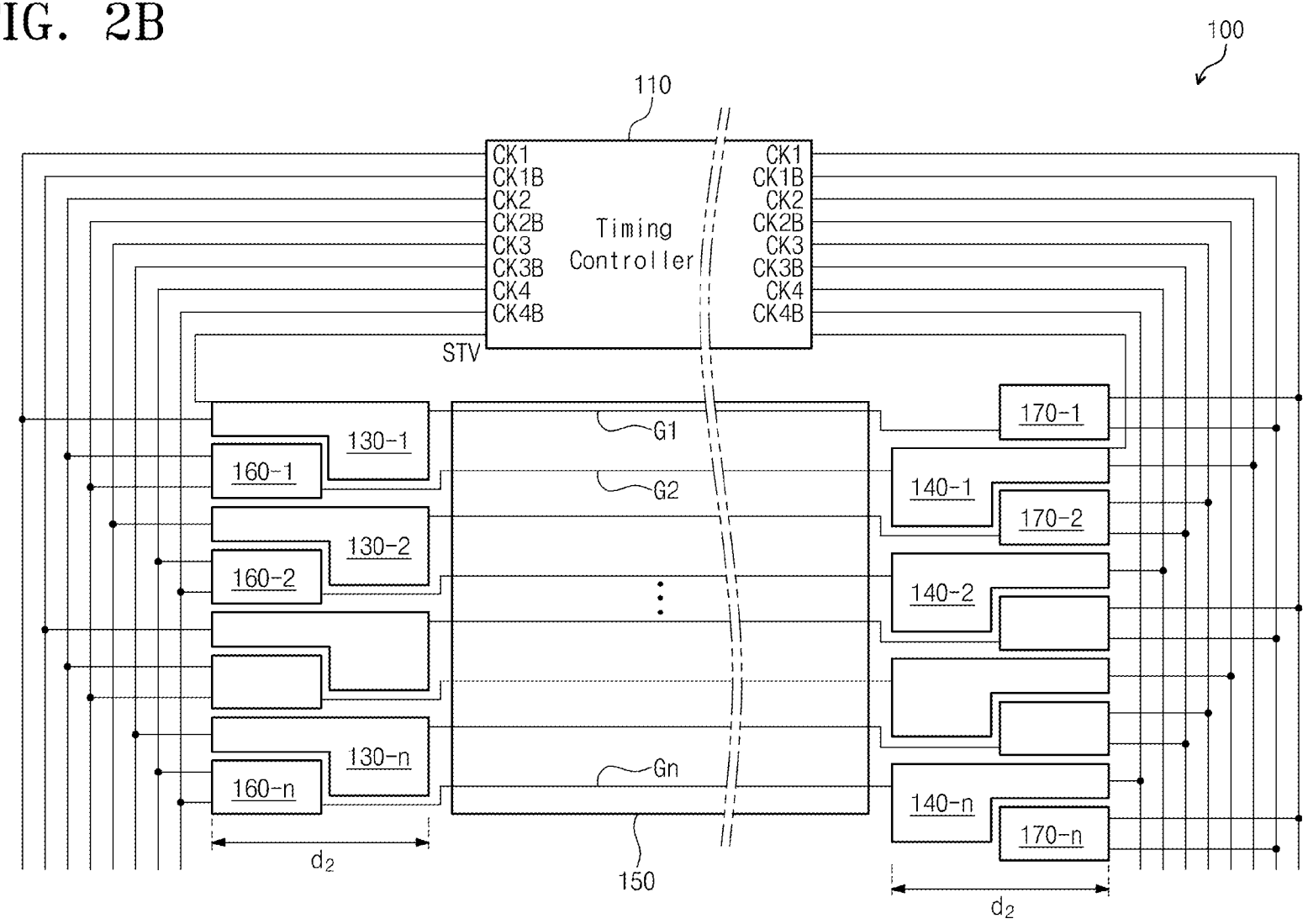
FIG. 2B is a block diagram of a display device that is driven in an interlace manner.

FIG. 2A is a block diagram of a display device that is driven in a dual manner. FIG. 2B is a block diagram of a display device that is driven in the interlace manner. The dual manner may represent a manner in which two gate drivers are connected to both ends of one gate line, and the gate signals are transmitted at the same time from both ends to drive the pixels PX11 to PXnm.

Referring to FIG. 2A, like the interlace manner, the gate drivers 130 and 140 transmitting the gate signals may be disposed on both sides of the display panel 150. However, unlike the interlace manner, two gate drivers 130-1 and 140-1 are connected to both ends of one gate line G1. Since the gate signals are transmitted at the same time from both ends of the one gate line G1 in the dual manner, the gate signal propagation delay may be minimized to prevent the horizontal line defects from occurring.

However, in the case of the dual manner, since the gate drivers 130 and 140 having a wide width are disposed on both sides of the display area 150, it may be difficult to realize the narrow bezel of the display device 100.

Thus, in this specification, the display device 100 may include the compensation circuits that realize the narrow bezel of the display device 100 and prevent the horizontal line defects from occurring in the interlace manner.

Referring to FIG. 2B, the display device 100 may include first compensation circuits 171-1 to 171-n that one-to-one correspond to first gate drivers 130-1 to 130-n. Also, the display device 100 may include second compensation circuits 161-1 to 161-n that one-to-one correspond to the second gate drivers 140-1 to 140-n. The first and second gate drivers 130-1 to 130-n and 140-1 to 140-n may be respectively disposed on both sides of the display area 150, and also, the first and second compensation circuits 171-1 to 171-n and 161-1 to 161-n may be respectively disposed on both sides of the display area 150.

The first gate drivers 130-1 to 130-n may be disposed adjacent to a first side of the display area, and the first compensation circuits 171-1 to 171-n respectively corresponding to the first gate drivers 130-1 to 130-n may be disposed adjacent to a second side of the display area 150. The second gate drivers 140-1 to 140-n may be disposed adjacent to the second side of the display area 150, and the second compensation circuits 161-1 to 161-n respectively corresponding to the second gate drivers 140-1 to 140-n may be disposed adjacent to the first side of the display area 150.

That is, the first gate drivers 130-1 to 130-n and the second compensation circuits 161-1 to 161-n may be disposed on the first side of the display area, and the second gate drivers 140-1 to 140-n and the first compensation circuits 171-1 to 171-n may be disposed on the second side of the display area. The first gate drivers 130-1 to 130-n and the second compensation circuits 161-1 to 161-n may be alternately disposed in a vertical direction, and the second gate drivers 140-1 to 140-n and the first compensation circuits 171-1 to 171-n may also be alternately disposed in the vertical direction.

Referring to FIGS. 2A and 2B, the interlace manner may be advantageous to manufacturing cost and design because the interlace manner requires a relatively narrow width (d1>d2) and the relatively less number of gate drivers 130 and 140 when compared to the dual manner. However, in the interlace manner, the horizontal line defects may occur due to the gate signal propagation delay. Thus, in this specification, the display device 100 may include the compensation circuits 160 and 170 that realize the narrow bezel and prevent the horizontal line defects from occurring in the interlace manner. Hereinafter, the compensation circuits will be described later in detail.

FIGS. 3 to 7 are circuit diagrams of a compensation circuit.

Figure 3:
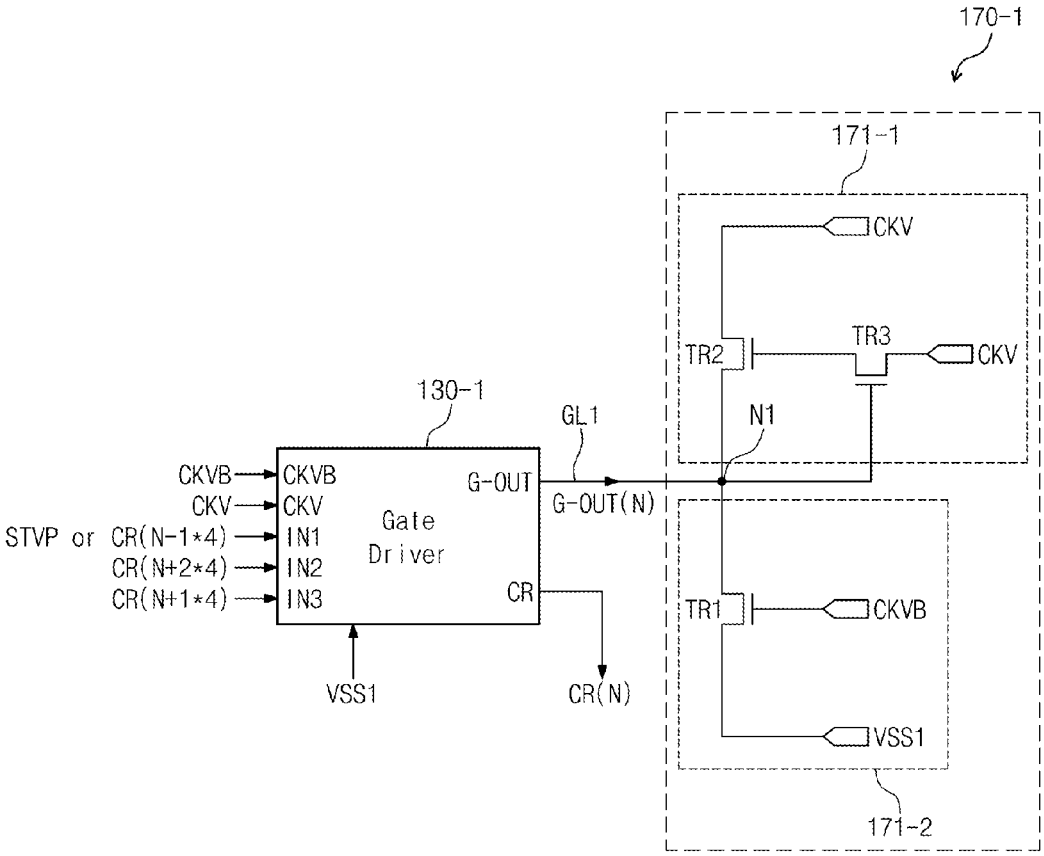
FIGS. 3, 4, 5, 6 and 7 are circuit diagrams of a compensation circuit.

Referring to FIG. 3, the gate driver 130-1 outputs a carry signal CR(N) and a gate signal G-OUT(N) in response to a clock signal CKV, an inversion clock signal CKVB, a vertical starting signal STVP or a carry signal CR(N−1*4) of a previous gate driver, and carry signals CR(N+1*4), CR(N+2*4) of next gate drivers.

The gate driver 130-1 may be connected to a first node N1 of the compensation circuit 170-1 through a gate line GL1. The gate driver 130-1 may transmit the gate signal G-OUT(N) to the first node N1 of the compensation circuit 170-1 through the gate line GL1.

The compensation circuit 170-1 may include a discharge unit 171-2 and a precharge circuit 171-1. The discharge unit 171-2 may compensate a falling time of the gate signal G-OUT(N) transmitted from the gate driver 130-1 through the gate line GL1. The precharge circuit 171-1 may compensate a rising time of the gate signal G-OUT(N) transmitted from the gate driver 130-1 through the gate line GL1.

The discharge unit 171-2 may be connected to the first node N1 and a first voltage terminal and include a first transistor TR1 that is controlled by the inversion clock signal CKVB. Here, the inversion clock signal CKVB may represent a signal CKVB in which a clock signal CKV inputted into the gate driver 130-1 connected to the compensation circuit 170-1 including the discharge unit 171-2 is inverted. The first voltage terminal may have a ground voltage level VSS1.

When the inversion clock signal CKVB is supplied to the gate driver 130-1 and the compensation circuit 170-1, the first transistor TR1 is turned on, thus, the first node N1 may be discharged to the ground voltage level VSS1. The display device 100 may include the compensation circuit 170-1 to additionally secure a path in which the gate signal G-OUT(N) of the gate line GL1 is discharged. As a result, the display device 100 may compensate the falling time of the gate signal G-OUT(N).

The precharge circuit 171-1 may include a second transistor TR2 and a third transistor TR3. The second transistor TR2 is connected between the first node N1 and the clock signal CKV. The third transistor TR3 is connected between a gate of the second transistor TR2 and the clock signal CKV and includes a gate connected to the first node N1.

When the clock signal CKV supplied to the gate driver 130-1 rises from the low level to the high level, since the gate signal G-OUT(N) is transmitted to the first node N1, the first node N1 may also rise from the low level to the high level. As a result, the third transistor TR3 and the second transistor TR2 may be successively turned on to transmit the clock signal CKV to the first node N1. Thus, a voltage level of the first node N1 ascends.

The display device 100 may include the compensation circuit 170-1 to additionally secure a path in which the gate signal G-OUT(N) of the gate line GL1 is charged. As a result, the display device 100 may compensate the rising time of the gate signal G-OUT(N).

The precharge circuit 171-1 may additionally include at least one capacitor to secure a stable operation of the second transistor TR2.

Figure 4:
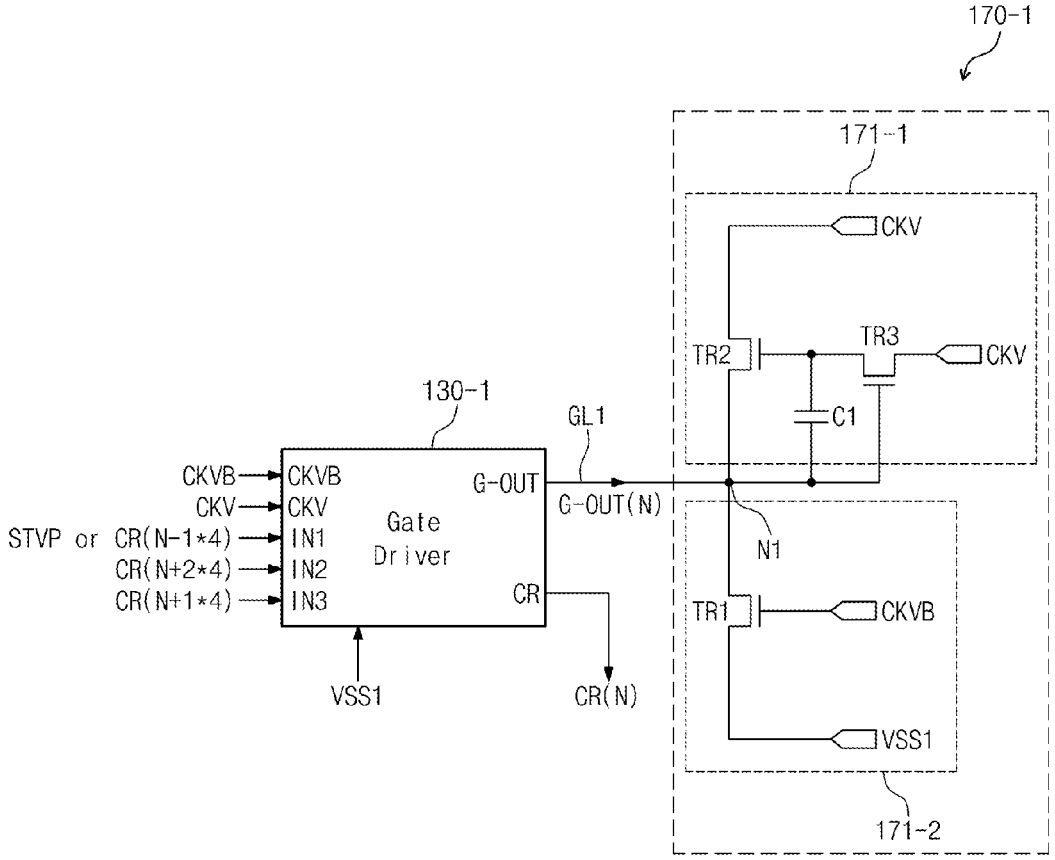

Referring to FIG. 4, the precharge circuit 171-1 of FIG. 3 may additionally include a first capacitor C1 connected between the first node N1 and the gate of the second transistor TR2.

Figure 5:
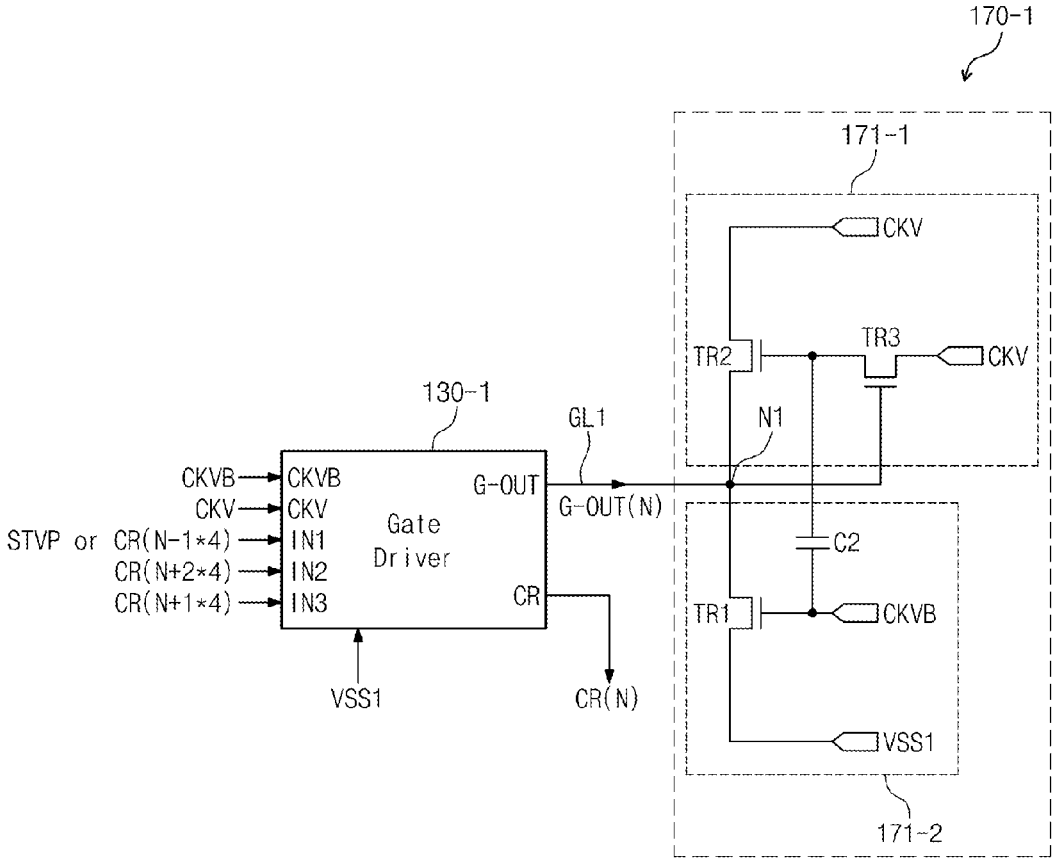

Referring to FIG. 5, the precharge circuit 171-1 of FIG. 3 may additionally include a second capacitor C2 connected between the gate of the second transistor TR2 and the gate of the first transistor TR1.

The first and second capacitors C1 and C2 are connected to the gate of the second transistor TR2 within the compensation circuit 170-1. The first and second capacitors C1 and C2 may stably maintain a voltage of the gate of the second transistor TR2 to prevent ripple of the first node N1 from occurring.

Figure 6:
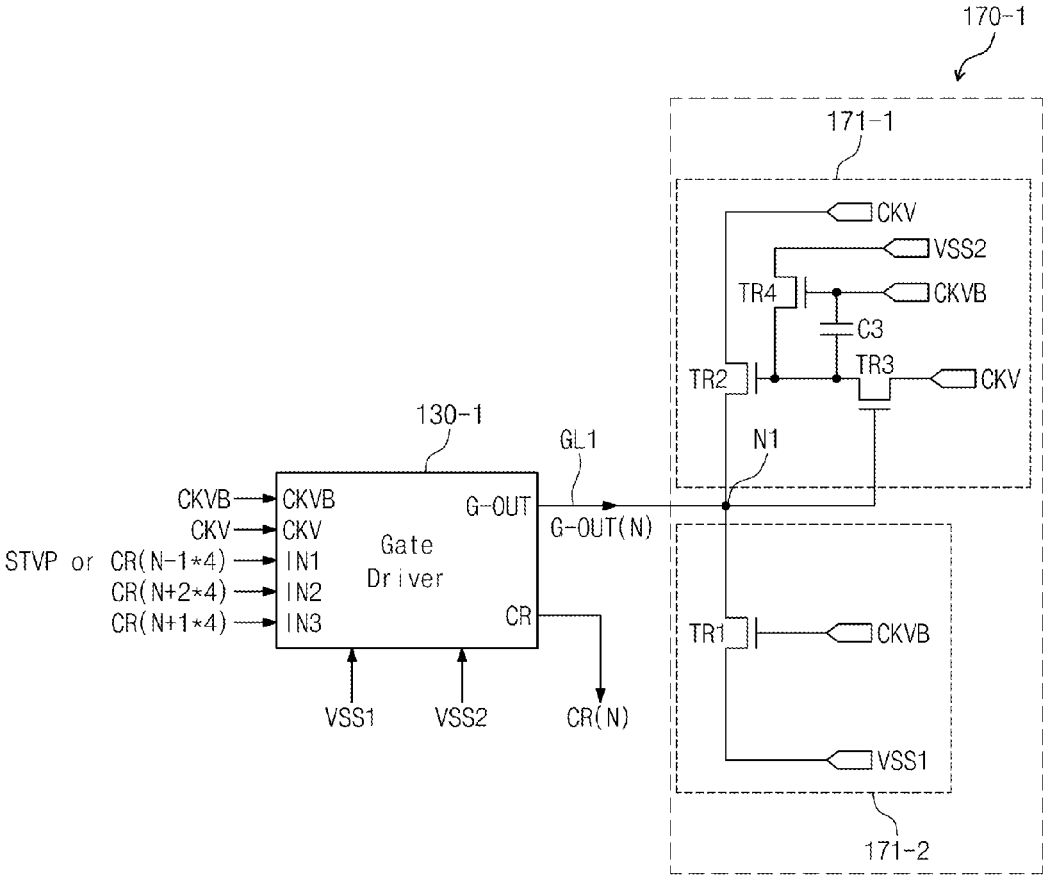

Referring to FIG. 6, the precharge circuit 171-1 of FIG. 3 may additionally include a fourth transistor TR4 and a third capacitor C3 to prevent the ripple of the first node N1 from occurring. Here, the fourth transistor TR4 may be connected between the gate of the second transistor TR2 and a second voltage terminal VSS2. A voltage level of the second voltage terminal may be less than the voltage level VSS1 of the first voltage terminal.

The fourth transistor TR4 is turned on when the inversion clock signal CKVB rises to the high level. As a result, the gate of the second transistor TR2 is discharged to the voltage level VSS2 of the second voltage terminal Thus, the second transistor TR2 is not turned on while the inversion clock signal CKVB is in the high level.

The third capacitor C3 may be connected to a gate of the fourth transistor TR4 and the gate of the second transistor TR2.

Like the first and second capacitor C1 and C2, the fourth transistor TR4 and the third capacitor C3 may also be connected to the gate of the second transistor TR2 to stably maintain the gate voltage of the second transistor TR2. Thus, the ripple of the first node N1 may be prevented.

Figure 7:
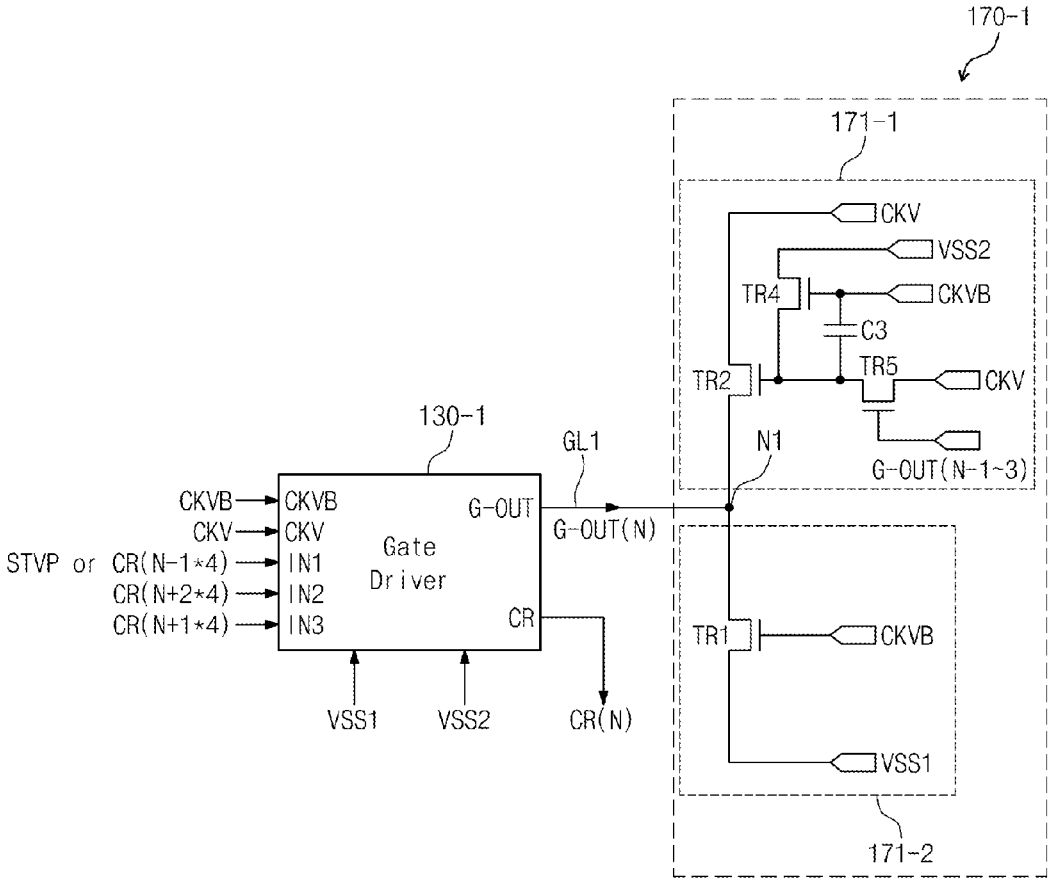

Referring to FIG. 7, the precharge circuit 171-1 of FIG. 3 may be connected to the gate of the second transistor TR2 and the second voltage terminal and may additionally include the fourth transistor TR4 and a third capacitor C3 connected between the gate of the second transistor TR2 and the gate of the fourth transistor TR4. Also, the precharge circuit 171-1 may be connected between the gate of the second transistor TR2, instead of the third transistor TR3, and the clock signal CKV and may include a fifth transistor TR5 controlled by a gate signals G-OUT(N-1 to 3) received from the previous gate driver. The previous gate driver may be called a gate driver that outputs the gate signal before the present gate driver 130-1 outputs the gate signal. Thus, the gate signals G-OUT(N-1 to 3) of the previous gate driver may represent gate signals that are outputted before the gate signal G-OUT(N) of the present gate driver 130-1 is outputted.

The compensation circuit of the FIG. 7 may precharge the first node N1 in response to the previous gate signals G-OUT (N1 to 3), thus, may have excellent compensation for the rising time. Detailed description with respect to the above-described effects will be described below with reference to the timing chart of FIG. 8.

Figure 8:
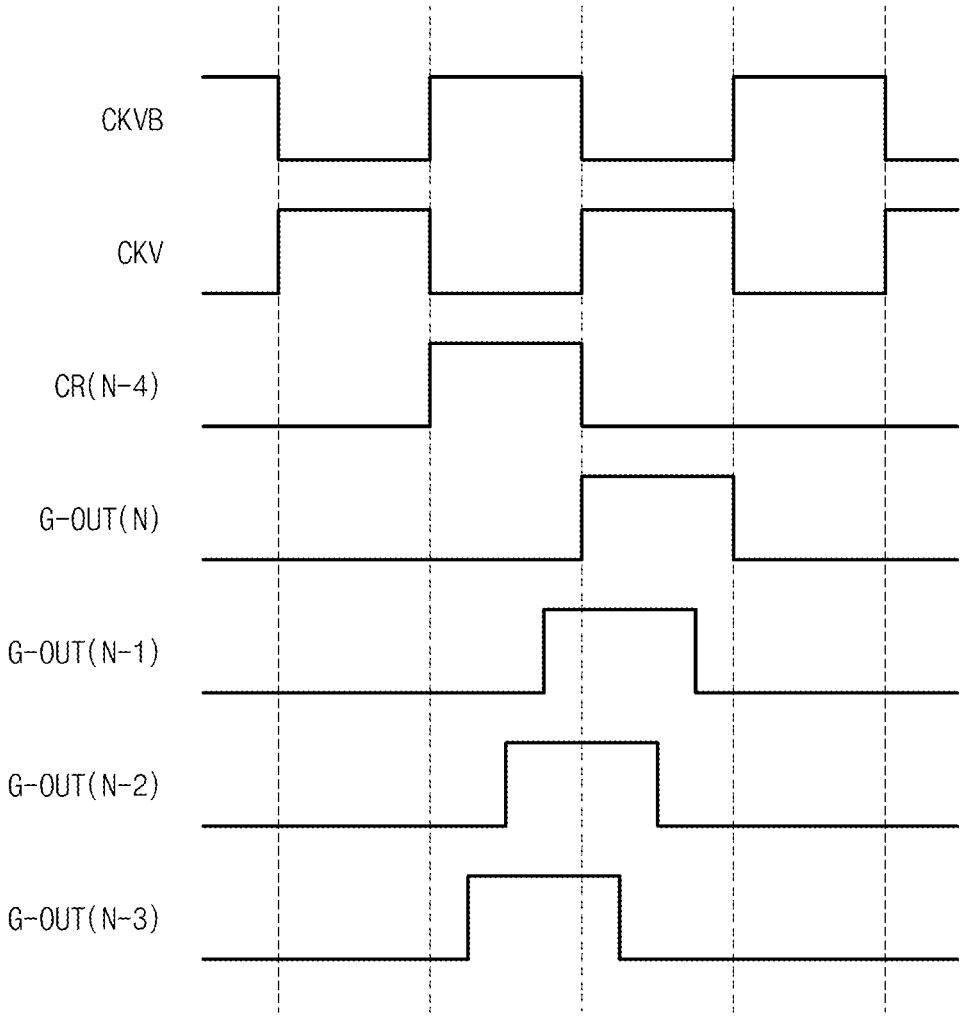
FIG. 8 is a timing chart of signals used in the circuit diagram illustrated in FIG. 7.

FIG. 8 is a timing chart of signals used in the circuit diagram illustrated in FIG. 7.

Referring to FIG. 8, when a carry signal CR(N-4) from the previous gate driver 130-1 is falling, the gate driver 130-1 outputs the clock signal CKV that has the high level to the gate signal G-OUT(N) in response to the carry signal CR(N-4).

While the carry signal CR(N-4) is in the high level, the gate signals G-OUT(N-1~3) activated from the previous gate drivers may be transmitted to the compensation circuit 170-1. The transmitted previous gate signals G-OUT(N-1 to 3) may turn on the fifth transistor TR5 of the compensation circuit 170-1. The fifth transistor TR5 may turn on the second transistor TR2 to precharge the first node N1 just when the clock signal CKV has the high level. Thus, the rising time for which the gate signal G-OUT(N) of the first node N1 is charged to a high level may be reduced.

When the clock signal CKV falls from the high level to the low level, the gate signal G-OUT(N) may falls from the high level to the low level in response to the clock signal CKV.

As the clock signal CKV falls to the low level, the inversion clock signal CKVB may rise from the low level to the high level. Here, the first transistor TR1 of the compensation circuit 170-1 may be turned on to discharge the first node N1. Thus, the falling time for which the gate signal G-OUT(N) of the first node N1 is discharged may be reduced.

Figure 9:
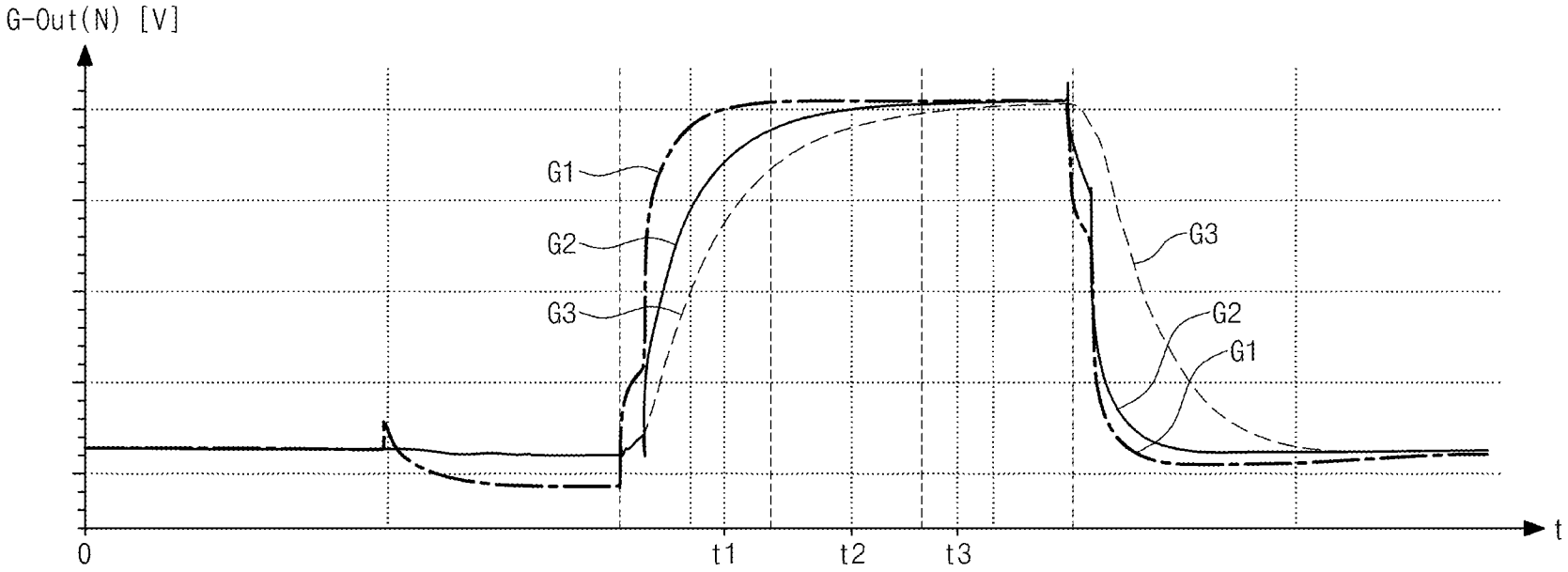
FIG. 9 is a gate signal of the circuit diagram of FIG. 7 and a conventional circuit.

FIG. 9 is a gate signal graph of the circuit diagram of FIG. 7. Gate signals respectively outputted from the dual type gate driver, the interlace type gate driver that does not include the compensation circuit, the interlace type gate driver including the compensation circuit (the gate driver including the circuit of FIG. 7) were recorded according to a variation in time.

Referring to FIG. 9, a first waveform G1 may be a gate signal waveform outputted from the dual type gate driver, a second waveform G2 may be a gate signal waveform outputted from the circuit of FIG. 7, and a third waveform G3 may be a gate signal waveform outputted from the interlace type gate driver that does not have the compensation circuit 170-1.

Referring to each of the waveforms G1 to G3, the rising time until the gate signals rises to the same voltage level was gradually reduced in order of the first waveform G1→the second waveform G2→the third waveform G3. That is, it was confirmed that a rising time t2 in the interlace type gate driver including the compensation circuit 170-1 is shorter than a rising time t3 of the interlace type gate driver that does not include the compensation circuit 170-1.

Also, the falling time until the gate signals fall to the same voltage level was gradually reduced in order of the first waveform G1→the second waveform G2→the third waveform G3. Particularly, a difference between the falling times of the second waveform G2 and the third waveform G3 was large, and the falling times of the first waveform G1 and the second waveform G2 were little difference.

That is, the interlace type gate driver which includes the compensation circuit 170-1 has improved rising and falling times than the interlace type gate driver which does not include the compensation circuit 170-1.

According to the inventive concept, the gate driver may be reduced in total width to realize the narrow bezel of the display panel.

Also, according to the inventive concept, an occurrence of the horizontal line defects in the display device that is realized in an interlace manner may be minimized.

For convenience of description, although the drawings are separately described, the embodiments with reference to the drawings may be combined with each other to realize a new embodiment. Also, in the description of the display device 100, the embodiments set forth therein is not so limitedly, but all or part of the embodiments can be selectively combined so as to derive many variations.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display apparatus comprising:

a plurality of data lines;

a data driver connected to an end of each of the plurality of data lines;

a plurality of gate lines;

gate drivers connected to the plurality of gate lines and outputting a plurality gate signals in response to a clock signal, wherein the gate drivers comprise first gate drivers respectively connected to one ends of a first group of the plurality of gate lines and second drivers respectively connected to one ends of a second group of the plurality of gate lines;

compensation circuits for compensating a rising time and falling time of gate signals outputted from the gate drivers, wherein the compensation circuits comprise first compensation circuits respectively connected to the other ends of the first group of the plurality of gate lines and second compensation circuits respectively connected to the other ends of the second group of the plurality of gate lines; and a plurality of pixels respectively disposed on areas between the gate drivers, wherein the gate drivers are connected to first nodes of the compensation circuits through the plurality of gate lines, respectively, wherein each of the compensation circuits including a precharge circuit compensating the rising time of each of the gate signals and a discharge unit compensating the falling time of each of the gate signals, and wherein the discharge unit includes a first transistor that is connected between each of the first nodes and a first voltage terminal and controlled by an inversion clock signal.

2. The display apparatus of claim 1, wherein the first and second gate drivers are disposed to face each other with an intervening display area on which the plurality of pixels are disposed.

3. The display apparatus of claim 2, wherein the first and second compensation circuits are disposed to face each other with the intervening display area.

4. The display apparatus of claim 3, wherein the first gate drivers and the second compensation circuits are alternately arranged in a vertical direction, and the second gate drivers and the first compensation circuits are alternately arranged in the vertical direction.

5. The display apparatus of claim 1, wherein the first voltage terminal has a ground voltage level.

6. The display apparatus of claim 5, wherein the precharge circuit comprises:

a second transistor connected between the first node and the clock signal; and a third transistor connected between a gate of the second transistor and the clock signal, the third transistor comprising a gate connected to the first node.

7. The display apparatus of claim 6, wherein the precharge circuit further comprises a first capacitor connected between the first node and the gate of the second transistor.

8. The display apparatus of claim 6, wherein the precharge circuit further comprises a second capacitor connected between the gate of the second transistor and a gate of the first transistor.

9. The display apparatus of claim 6, further comprising:

a fourth transistor connected between the gate of the second transistor and a second voltage terminal; and a third capacitor connected between a gate of the fourth transistor and the gate of the second transistor.

10. The display apparatus of claim 9, wherein the second voltage terminal has a voltage level less than a voltage level of the first voltage terminal.

11. The display apparatus of claim 5, wherein the precharge circuit comprises:

a second transistor connected between the first node and a non-inversion clock signal;

a fourth transistor connected between a gate of the second transistor and a second voltage terminal, the fourth transistor being controlled by the inversion clock signal;

a third capacitor connected between the gate of the second transistor and a gate of the fourth transistor; and a fifth transistor connected between the gate of the second transistor and the clock signal, the fifth transistor being controlled by a gate signal received from a previous gate driver.

12. A display apparatus comprising:

a plurality of data lines;

a data driver connected to an end of each of the plurality of data lines;

a plurality of gate lines;

gate drivers connected to the plurality of gate lines, wherein the gate drivers comprise first gate drivers respectively connected to one ends of a first group of the plurality of gate lines and second drivers respectively connected to one ends of a second group of the plurality of gate lines;

compensation circuits for compensating a rising time and falling time of gate signals outputted from the gate drivers, wherein the compensation circuits comprise first compensation circuits respectively connected to the other ends of the first group of the plurality of gate lines and second compensation circuits respectively connected to the other ends of the second group of the plurality of gate lines; and a plurality of pixels respectively disposed on areas between the gate drivers, wherein each of the compensation circuits comprises:

a first transistor comprising an input electrode which receive a ground voltage level, an output electrode connected to a gate line of plurality of gate lines, and a control electrode which receive an inversion clock signal, a second transistor comprising an input electrode which receive a clock signal, an output electrode connected to the gate line of plurality of gate lines, and a control electrode; and a third transistor comprising an input electrode which receive the clock signal, an output electrode connected to the gate electrode of the second transistor, and a control electrode connected to the gate line of plurality of gate lines.

* * * * *